US005174229A

United States Patent [19]

Adamski, Jr. et al.

[11] Patent Number: 5,174,229

[45] Date of Patent: Dec. 29, 1992

[54] LOADING DEVICE FOR A SEWING MACHINE

[75] Inventors: Maximilian Adamski, Jr., Palatine; Gary J. Michal, Streamwood, both of Ill.

[73] Assignee: Union Special Corporation, Huntley, Ill.

[21] Appl. No.: 514,791

[22] Filed: Apr. 26, 1990

[51] Int. Cl.[5] ..... D05B 35/02

[52] U.S. Cl. ..... 112/304; 112/314; 112/121.11; 271/270

[58] Field of Search ..... 112/304, 314, 318, 319, 112/322, 121.11, 121.12, 121.27; 271/270

[56] References Cited

U.S. PATENT DOCUMENTS 4,362,116 12/1982 Gupta et al. ..... 112/121.11 X
4,421,044 12/1983 Freermann et al. ..... 112/304 X
4,541,624 9/1985 Sasage et al. ..... 271/270 X
4,611,546 9/1986 Miyakawa ..... 112/121.11 X
4,813,364 3/1989 Boser ..... 112/304
4,863,154 9/1989 Hirakawa et al. ..... 271/270 X
5,005,502 4/1991 Gerardis et al. ..... 112/304 X

*Primary Examiner*—Peter Nerbun
*Attorney, Agent, or Firm*—Morgan & Finnegan

[57] ABSTRACT

A device for loading a garment for a sewing machine having a first device for moving the garment toward the sewing machine, a second device downstream of the first moving device for moving the garments towards the sewing machine, and a device for changing the speed of the first and second moving devices relative to each other to change the distance between adjacent moving garments according to programmed distance values.

13 Claims, 1 Drawing Sheet

LOADING DEVICE FOR A SEWING MACHINE

BACKGROUND OF THE INVENTION

A feature of the present invention is the provision of a loading device for a sewing machine.

During the processing of garments, such as sleeves, it is often desirable to sew the garments, such as hemming an edge of the sleeves by a suitable sewing machine. However, during processing of the sleeves for the sewing machine, it is normally desirable to align the sleeves during transport towards the sewing machine for sewing, and facilitate the loading of the sleeves for the alignment device and the sewing machine. Thus, if the operator places the sleeves too close together, they may obstruct each other during passage toward the sewing machine, and may be sewn together by the sewing machine which, of course, is undesirable. Also, the sleeves being too closely spaced could break parts of the sewing machine due to the double thickness, and cause downtime of the sewing machine until it is repaired. In addition, if the sleeves are too far apart during passage to the sewing machine, the sewing machine may sew a lengthy chain between the trailing and leading edges of the spaced garments which is undesirable.

SUMMARY OF THE INVENTION

A feature of the present invention is the provision of an improved device for loading a garment for a sewing machine.

The loading device of the present invention comprises, first means for moving the garments toward the sewing machine, second means downstream of the first moving means for moving the garments toward the sewing machine, means for changing the speed of the first and second moving means relative to each other to change the distance between adjacent moving garments.

A feature of the present invention is that the changing means changes the speed of the first moving means relative to the second moving means.

Another feature of the invention is that the changing means increases the speed of the first moving means relative to the second moving means in order to decrease the spacing between adjacent garments.

Yet another feature of the invention is that the changing means decreases the speed of the first moving means relative to the second moving means in order to increase the spacing between adjacent garments.

Thus, a feature of the present invention is that the loading device increases the spacing of adjacent garments to desired distances for passage to the sewing machine.

Still another feature of the invention is that the loading device decreases the distance between adjacent garments for passage to the sewing machine.

A feature of the present invention is that the device changes the distance between the garments in a simplified manner.

Still another feature of the invention is that the garments may be loaded on the loading device in a simplified manner.

Yet another feature of the invention is that the loading device is of simplified construction, and reduced cost.

A feature of the present invention is that the device has a loading station for the garments for placement on the first moving means.

Another feature of the invention is that the device has sensing means for sensing trailing and leading edges of the garments such that the changing means is responsive to the sensing means.

Still another feature of the invention is the sensing means is adjustable relative to the loading station.

A further feature of the invention is that the loading device is used in conjunction with an alignment device for the sewing machine.

Yet another feature of the invention is that in one embodiment the changing means may operate the moving means at a first fast speed and a second slow speed.

Another feature of the invention is that the changing means may operate the moving means at variable speeds.

A further feature of the invention is that the loading device may be controlled in a simplified manner.

Yet another feature of the invention is that the loading device improves the quality of the sewn garments by the sewing machine, and minimizes the possibility of damage to the sewing machine during use.

A feature of the present invention is that the distance between adjacent sleeves may be controlled according to programmed distance values.

Further features will become more fully apparent in the following description of the embodiments of this invention and from the appended claims.

DESCRIPTION OF THE PREFERRED EMBODIMENTS

Figures 1, 2, 3:
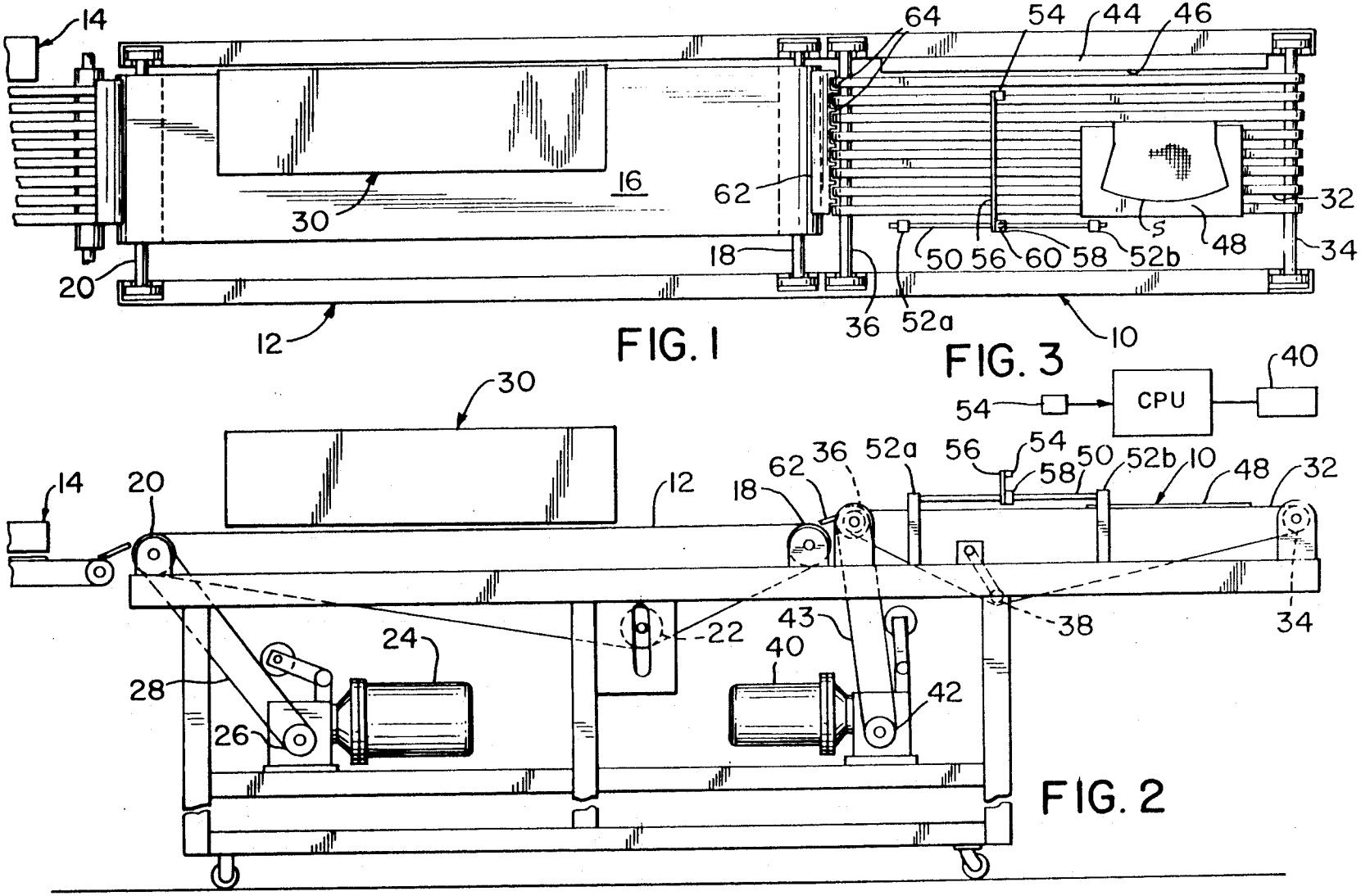
FIG. 1 is a fragmentary plan view of a loading device of the present invention.
FIG. 2 is a fragmentary elevational view of the loading device of FIG. 1.
FIG. 3 is a schematic view of a control system for the device of FIG. 1.

Referring now to FIGS. 1 and 2, there is shown a loading device generally designated 10 which is used in conjunction with an alignment device generally designated 12 and a sewing machine generally designated 14. The alignment device 12 may be of known construction, such as an alignment device disclosed in U.S. Ser. No. 405,704, filed Sep. 11, 1989, incorporated herein by reference, or U.S Ser. No. 07/514,827, filed Apr. 26, 1990, incorporated herein by reference. The alignment device 12 may have an endless conveyor belt 16 passing around a first rotatably mounted roller 18, a second rotatably mounted roller 20, and a third rotatably mounted roller 22. The alignment device 12 has a drive motor 24 which drives a pulley 26, with an endless belt 28 passing around the pulley 26 and the second roller 20 in order to drive the conveyor belt 16 about the rollers 18, 20, and 22. In a suitable form, the motor 24 may be an A. C. motor. The alignment device 12 may have a suitable alignment section 30, such as disclosed in said U.S. Ser. No. 07/514,827, located over the conveyor belt 16 in order to align the garments or workpieces, such as sleeves, for the sewing machine 14 during passage of the garments toward the sewing machine 14. Thus, the motor 24 drives the belt 16 in a direction for passage of the sleeves or garments through the alignment station 30 toward the sewing machine 14.

The loading device 10 has a plurality of laterally spaced endless belts 32 passing over a first rotatable roller 34, a second rotatable roller 36, and a third rotatable roller 38. As shown, the loading device 10 has a motor 40, such as a suitable D. C. drive motor, which drives a pulley 42. The loading device 10 has an endless belt 43 passing over the second roller 36 and the pulley 42 in order to drive the belts 32 in a direction moving the garments in a downstream direction toward the alignment device 12, with the belts 32 of the loading device 10 being driven faster than the belt 16 of the alignment device 12.

The loading device 10 has a longitudinally extending edge member 44 defining a longitudinally extending edge 46 adjacent one side of the belts 32. The loading device has a loading plate or station 48 located adjacent the other side of the belts 32 and defining a space, such as approximately 1 ½", between the edge 46 and the loading plate or station 48. Thus, the sleeves may be stacked on the loading plate 48 preparatory to use by the operator.

As shown, the loading device 10 has an elongated rod 50 which is mounted between a pair of holding members 52*a* and 52*b* downstream of the loading plate 48. The loading device 10 has a sensor 54 secured to a flange 56 which is connected to a bushing 58 slidably mounted on the rod 50. The bushing 58 may be secured at a desired location on the rod 50 downstream from the loading plate 48 by a suitable bolt 60, passing through the bushing 58 and bearing against the rod 50, in order to adjust and releasably secure the bushing and sensor 54 at a desired location. With reference to FIG. 3, the sensor 54 is electrically connected to a central processing unit (C.P.U.), and the CPU is electrically connected to the motor 40 in order to control the motor 40. If desired, the CPU may also be electrically connected to the motor 24 of the alignment device 12, as will be further described below.

If desired, the loading device 10 may have a plate 62 extending laterally across the belts 32 and having a plurality of spaced fingers 64 located between a downstream part of the belts 32. The plate 62 permits passage of the sleeves from the belts 32 onto the conveyor belt 16 of the alignment device 12.

In use, the operator places the sleeves on the belts 32 of the loading device 10, with an edge or margin of the sleeves being located intermediate the edge 46 of the edge member 44 and the loading plate 48 on the belts 32, such that the sleeves pass in a downstream direction by the belts 32 beneath a sensor 54 and the sensor 54 detects the trailing and leading edges of the sleeves. Thus, the sensor 54 detects the trailing edge of a first sleeve, and a leading edge of a second sleeve, as adjacent sleeves pass sequentially beneath the sensor 54 and an electrical signal from the sensor 54 is received by the central processing unit CPU. In turn, the CPU determines the time or measures the time between the trailing and leading edges of the sleeves, and may readily determine the distance between adjacent sleeves due to the known speed of the belts 32. The CPU controls the motor 40 in order to slow down the belts 32, relative to the belt 16 in order to increase the spacing between adjacent sleeves a desired programmed distance by changing the speed of the motor 40 as the sleeves pass onto the conveyor belt 16 of the alignment device 12. In the event that the sleeves are placed on the loading device 10 at a greater distance than desired between adjacent sleeves, the signals as sensed by the sensor 54 between the trailing and leading edges of the adjacent sleeves is processed by the CPU, which speeds up the belts 32 relative to the belt 16 to decrease the spacing between adjacent sleeves as they pass onto the conveyor belt 16 of the alignment device 12. Thus, the operator may rapidly place the sleeves in a simplified manner on the loading device 10 upstream from the sensor 54 as the loading device automatically separates the sleeves in order to prevent them from bunching up as they pass to the sewing machine 14, which may otherwise cause sewing of the sleeves together and could break parts on the sewing machine due to the double thicknesses causing undesirable downtime and repair of the sewing machine 14. Also, in the event that the sleeves are too far apart, the loading device 14 automatically decreases the distance between the adjacent sleeves in order to minimize the thread chain sewn between adjacent sleeves with an undue length, which is undesired. The sleeves pass onto the alignment device from the loading device 10, and are aligned by the alignment station 30 for the location for passage to the sewing machine 14 and sewing as desired.

If desired, the central processing unit (CPU) of FIG. 3 may also control the motor 24 of the alignment device 12 in order to control the speed of the conveyor belt 16 relative to the belts 32 of the loading device 10. In this manner, both motors 24 and 40 may be controlled by the central processing unit in order to control the relative speed of the belts 32 and 16 to modify or change the distance between adjacent sleeves, either by increasing the distance between the sleeves or decreasing the distance, as previously described. In one form, the motor 40 may have a first fast speed and a second slow speed, as controlled by the CPU. However, if desired, the motor 40 may have a continuous range of change of speeds.

The foregoing detailed description is given for clearness of understanding only, and no unnecessary limitations should be understood therefrom, as modifications will be obvious to those skilled in the art.

What is claimed is:

1. A device for loading workpieces for a sewing machine, comprising:

first means for moving the workpieces towards the sewing machine;

second means downstream of the first moving means and upstream of the sewing machine for moving the workpieces toward the sewing machine; and means for actively changing the speed of the first and second moving means relative to each other to change the distance between adjacent moving workpieces according to programmed distance values.

2. The device of claim 1 wherein the changing means increases the speed of the first moving means relative to the second moving means in order to decrease the spacing between adjacent workpieces.

3. The device of claim 1 wherein the changing means decreases the speed of the first moving means relative to the second moving means in order to increase the spacing between adjacent workpieces.

4. A device for loading workpieces for a sewing machine, comprising:

a first conveyor for moving the workpieces toward the sewing machine;

a second conveyor downstream of the first conveyor and upstream of the sewing machine;

means for sensing the trailing edge of a first moving workpiece and a leading edge of a subsequent second moving workpiece; and means, responsive to the sensing means, for actively changing the speed of the first and second conveyors relative to each other to modify a distance between the first and second workpieces.

5. The device of claim 4 wherein the changing means alters the relative speed of the conveyors so as to decrease the distance between the first and second workpieces in accordance with a programmed distance value.

6. The device of claim 4 wherein the changing means alters the relative speed of the conveyors so as to increase the distance between the first and second workpieces in accordance with a programmed distance value.

7. The device of claim 4 wherein the changing means comprises means for driving the first conveyor.

8. The device of claim 7 wherein the driving means has a first fast speed and a second slow speed.

9. The device of claim 7 wherein the driving means has a continuous range of speeds.

10. A device for loading workpieces for a sewing machine, comprising:

a first conveyor for moving the workpieces toward the sewing machine;

a second conveyor downstream of the first conveyor and upstream of the sewing machine;

a sensor for detecting the positions of the workpieces; and a controller, responsive to the sensor, for actively changing the speed of the first and second conveyors relative to each other to change a distance between adjacent moving workpieces according to programmed distance values.

11. The device of claim 10 wherein the controller alters the relative speed of the conveyors so as to increase the distance between the workpieces.

12. The device of claim 10 wherein the controller alters the relative speed of the conveyors so as to decrease the distance between the workpieces.

13. A device for loading workpieces for a sewing machine, comprising:

means for moving the workpieces toward the sewing machine;

means for sensing the trailing edge of a first moving workpiece and a leading edge of a subsequent second moving workpiece;

means for actively changing the speed of the moving means to modify a distance between the first and second workpieces; and means responsive to the sensing means for measuring the distance between the trailing and leading edges of the first and second moving workpieces, and in which the changing means is responsive to the measuring means.

* * * * *